US008997292B2

(12) United States Patent
Li et al.

(10) Patent No.: US 8,997,292 B2
(45) Date of Patent: Apr. 7, 2015

(54) EXTENDED-SPAN AND ALTERNATIVELY-SHAPED ARCH BRIDGE AND CONSTRUCTION METHOD THEREFOR

(75) Inventors: Yong Li, Shenzhen (CN); Yiyan Chen, Shenzhen (CN); Min Li, Shenzhen (CN); Shuai Guo, Shenzhen (CN); Fangfang Xiao, Shenzhen (CN)

(73) Assignees: Shenzhen Bridge Design & Research Institute Co., Ltd., Shenzhen (CN); Shenzhen Municipal Design & Research Institute Co., Ltd., Shenzhen (CN)

( * ) Notice: Subject to any disclaimer, the term of this patent is extended or adjusted under 35 U.S.C. 154(b) by 0 days.

(21) Appl. No.: 14/347,508

(22) PCT Filed: Sep. 30, 2011

(86) PCT No.: PCT/CN2011/080400

§ 371 (c)(1),
(2), (4) Date: Mar. 26, 2014

(87) PCT Pub. No.: WO2013/044493

PCT Pub. Date: Apr. 4, 2013

(65) Prior Publication Data

US 2014/0223674 A1 Aug. 14, 2014

(51) Int. Cl.
*E01D 4/00* (2006.01)
*E01D 6/02* (2006.01)
(Continued)

(52) U.S. Cl.
CPC .. *E01D 4/00* (2013.01); *E01D 6/02* (2013.01); *E01D 21/00* (2013.01); *E01D 12/00* (2013.01)

(58) Field of Classification Search
CPC ..... E01D 11/00–12/00; E01D 19/02; E01D 19/14–21/065
USPC ..... 14/2, 8–26, 73, 74–78
See application file for complete search history.

(56) References Cited

U.S. PATENT DOCUMENTS 5,070,566 A * 12/1991 Lin et al. ..... 14/19
(Continued)

FOREIGN PATENT DOCUMENTS

CN 1793514 A 6/2006
(Continued)

OTHER PUBLICATIONS

International Preliminary Report on Patentability and Written Opinion for Application No. PCT/CN2011/080400 dated Apr. 1, 2014.
(Continued)

*Primary Examiner* — Raymond W Addie
(74) *Attorney, Agent, or Firm* — Alston & Bird LLP

(57) ABSTRACT

A large-span and special-shaped arch bridge, comprising a main girder (2), a center abutment (11) served as a central bearing point and two auxiliary abutments (12,13) served as bearing points at two ends, wherein further comprising an arch-axis combination (3) and two arch-axis bending beams (4,5) presented as arcs projected upwards, the arch-axis combination being built on the center abutment (11) with two ends connected to the inner ends of the two arch-axis bending beams (4,5), the outer ends of the two arch-axis bending beams (4,5) being built on the two auxiliary abutments (12, 13), the two arch-axis bending beams (4,5) being connected to the main girder (2) via a plurality of inhaul cables. A method for constructing said arch bridge is also disclosed. Through the dual-arch axis of two arch-axis bending beams, the bending strength of the cross-section of the arch bridge is significantly increased, the bending moment of the cross-section of the arch at the central bearing point is decreased, the vertical displacement at the haunch of the arch is lesser, and the deformation of the main girder is reduced, thus the force of the entire bridge is more reasonable, the construction cost can effectively be reduced and the construction period can be shortened.

7 Claims, 7 Drawing Sheets

(51) Int. Cl.
*E01D 21/00* (2006.01)
*E01D 12/00* (2006.01)

(56) References Cited

U.S. PATENT DOCUMENTS

| | | | | |
|---|---|---|---|---|
| 6,401,285 | B1 * | 6/2002 | Morris | 14/19 |
| 6,785,925 | B1 * | 9/2004 | Donaldson | 14/22 |
| 7,062,812 | B1 * | 6/2006 | Morris | 14/18 |
| 7,469,438 | B2 * | 12/2008 | Li et al. | 14/24 |
| 8,042,213 | B2 * | 10/2011 | Yamane et al. | 14/18 |
| 8,572,787 | B2 * | 11/2013 | Toguchi | 14/18 |
| 8,752,225 | B2 * | 6/2014 | Meheen | 14/2 |

FOREIGN PATENT DOCUMENTS

| | | | |
|---|---|---|---|
| CN | 2913440 | Y | 6/2007 |
| CN | 201459588 | U | 5/2010 |
| CN | 102359059 | A | 2/2012 |
| KR | 100898013 | B1 | 5/2009 |

OTHER PUBLICATIONS

Written Opinion for Application No. PCT/CN2011/080400 dated Jun. 14, 2012.

International Search Report for Application No. PCT/CN2011/080400 dated Jun. 14, 2012.

* cited by examiner

EXTENDED-SPAN AND ALTERNATIVELY-SHAPED ARCH BRIDGE AND CONSTRUCTION METHOD THEREFOR

TECHNICAL FIELD

The present invention relates to bridges, particularly to a large-span combination arch bridge and a method for construction thereof.

PRIOR ART

Owing to the advantages of large span, beautiful shape and making full use of compressive strength of materials, more designs of arch bridge have been used in existing construction of bridges. However, there are some defects in the existing large-span arch bridges with larger horizontal thrust, greater difficulty in controlling lateral stability as well as higher difficulty in construction.

U.S. Pat. No. 7,469,438 discloses an arch axis which can effectively solve the above-mentioned defects and result in a reduced horizontal thrust of an arch bridge and a better lateral stability. However, it still has the following disadvantages:

1, due to the adjustment of the arch axis, the bending moment of the cross-section of main arch at the central bearing point is larger, and the material cost of the section of main arch is greater;

2, since the arch axis deviates from the pressure line of the arch, a greater bending moment and larger vertical displacement at the haunch of the arch are made, which leads to great deformation of main girder, therefore hardly meeting the functional requirements of normal working.

SUMMARY OF THE INVENTION

For lack of prior art, a first object of the present invention is to provide a large-span and special-shaped arch bridge which can effectively reduce the bending moment of the cross-section of main arch and the deformation of the main girder by adopting a dual-arch axis.

A second object of the present invention is to provide a method for constructing the large-span combination arch bridge mentioned above.

To achieve the first object, the present invention adopts the following technical solution:

A large-span and special-shaped arch bridge, comprising a main girder, a center abutment served as a central bearing point and two auxiliary abutments served as bearing points at two ends, wherein further comprising an arch-axis combination and two arch-axis bending beams presented as arcs projected upwards, the arch-axis combination being built on the center abutment with two ends connected to the inner ends of the two arch-axis bending beams, the outer ends of the two arch-axis bending beams being built on the two auxiliary abutments, the two arch-axis bending beams being connected to the main girder via a plurality of inhaul cables.

The arch-axis combination includes a lower arch axis and an upper arch axis, the lower arch axis is presented as a "V" shape and fixed to the center abutment at the bottom of the "V" shape, the upper arch axis is presented as a sunken arc and located in the opening of the "V"-shaped lower arch axis, and the two ends of the upper arch axis are connected to the two ends of the lower arch axis respectively.

The two ends of the upper arch axis are tangent to the two ends of the lower arch axis respectively, and the upper arch axis are docked with the two arch-axis bending beams respectively, which forms smooth curves.

Each arch-axis bending beam forks at the outer end thereof to form two bending beam legs connected to each corresponding auxiliary abutment.

Each arch-axis bending beam is formed by a plurality of bending beam segments butted in sequence.

To achieve the second object, the present invention adopts the following technical solution:

A construction method of the large-span and special-shaped arch bridge mentioned above, comprising the following steps:

A, constructs abutments including the center abutment located in the middle and two auxiliary abutments located at both ends of the bridge;

B, builds the arch-axis combination on the center abutment with segments one by one, and temporarily connects each segment of the arch-axis combination by means of inter-tube positioning;

C, builds the arch-axis bending beams presented as arcs projected upwards, which includes two sub-steps that can be performed in any particular order:

C1, butts the segments of the arch-axis bending beams in sequence from the built ends of the arch-axis combination to an end away from the center abutment;

C2, butts the segments of the arch-axis bending beams in sequence from each auxiliary abutment to an end near the center abutment;

D, docks the two ends of a closure segments of each arch-axis bending beam respectively with built nodes of each arch-axis bending beam implemented in the sub-steps C1,C2 to perform the closure of each arch-axis bending beam, and welds every adjacent segments of each arch-axis bending beam;

E, builds girder segments in sequence from the two auxiliary abutments to the center abutment, meanwhile builds the girder segments in sequence from the center abutment to both ends of the bridge, when building the girder segments in sequence from the two auxiliary abutments to the center abutment, connects every built girder segment with the corresponding arch-axis bending beam via cables;

F, performs the closure of the main girder, and welds the adjacent segments of the main girder.

In the step A, tower cranes are needed to be built respectively on the built center abutment and auxiliary abutments; the step C is specifically as follow:

in the sub-step C1, utilizes the tower crane on the center abutment to hoist the segments of each arch-axis bending beam, a plurality of segments of each arch-axis bending beam are butted in turn from an end of the arch-axis combination away from the center abutment, where the end is served as a starting end, after installing every segment of the arch-axis bending beam, temporarily connects the segments of each arch-axis bending beams to the tower crane of the center abutment by means of steel cable;

in the sub-step C2, builds the segments of each arch-axis bending beam by butt joint of the segments in turn from the legs of an ends of each arch-axis bending beam, where the legs are away from the center abutment and served as starting ends, each segment of the arch-axis bending beam is temporarily connected to the tower crane of the corresponding auxiliary abutment, in this respect, every segments of each arch-axis bending beam is hoisted by the tower crane on the corresponding auxiliary abutments.

In the step D, transits the closure segments of the arch-axis bending beams to the positions under the closure positions of the arch-axis bending beams, and utilizes a lifting tool to hoist the closure segments of the arch-axis bending beams.

The present invention is effective in that:

Through the dual-arch axis of two arch-axis bending beams, the bending strength of the cross-section of the arch bridge is significantly increased, the bending moment of the cross-section of the arch at the central bearing point is decreased, the vertical displacement at the haunch of the arch is lesser, and the deformation of the main girder is reduced, thus the force of the entire bridge is more reasonable. Meanwhile, by the method of the present invention, the construction cost can effectively be reduced and the construction period can be shortened.

DETAILED DESCRIPTION

Figure 1:
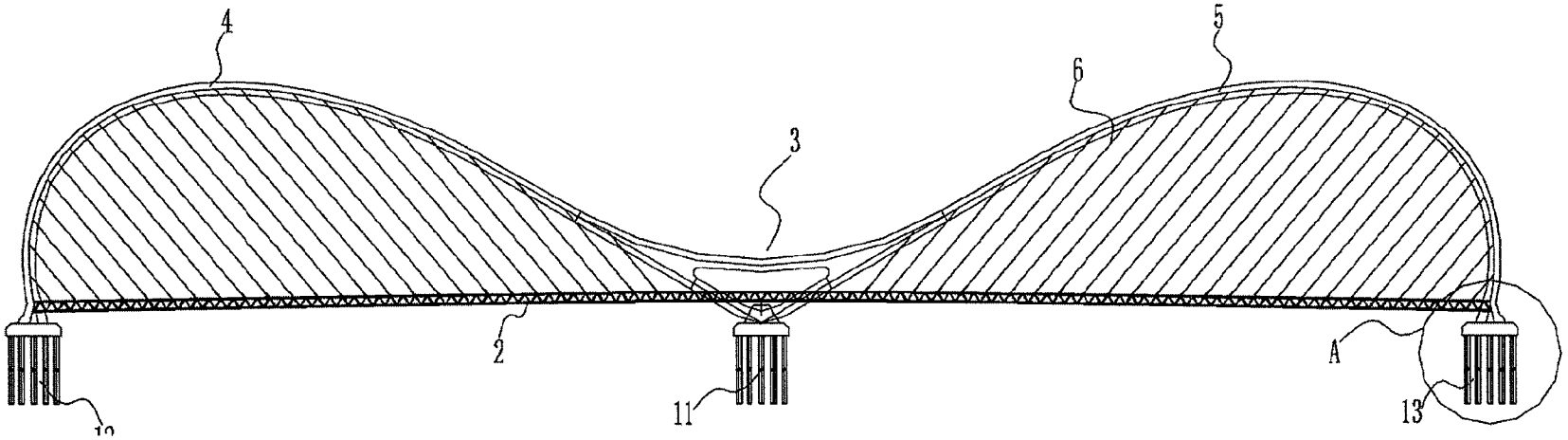
FIG. 1 is a schematic view of a large-span and special-shaped arch bridge according to an embodiment of the present invention.

Hereinafter is given embodiments accompanied with the drawings to describe the present invention in further details:

Referring to FIG. 1, a large-span and special-shaped arch bridge in accordance with an embodiment of the present invention is provided, which comprises a main girder 2, a center abutment 11 and two auxiliary abutments 12,13. The center abutment 11 is served as a central bearing point of the entire combination arch bridge, and the two auxiliary abutments 12, 13 as two bearing points at two ends of the bridge. An arch-axis combination 3 is fixed on the center abutment 11. The center abutment 11 connects to the two auxiliary abutments 12,13 with an arch-axis bending beam 4,5 respectively. The arch-axis bending beams 4,5, which are provided with an arch axis respectively, arranged symmetrically and each presented as an arc projected upwards, are respectively formed by a plurality of arch-axis bending beam segments butted in sequence.

Figure 2:
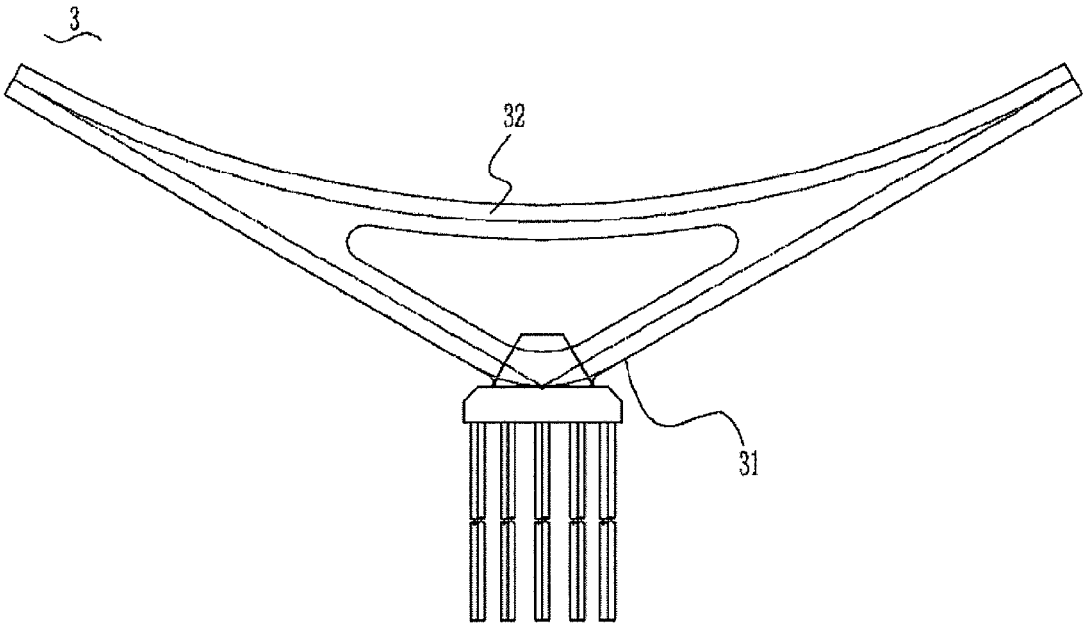
FIG. 2 is a schematic view of the arch-axis combination of FIG. 1.
Figure 3:
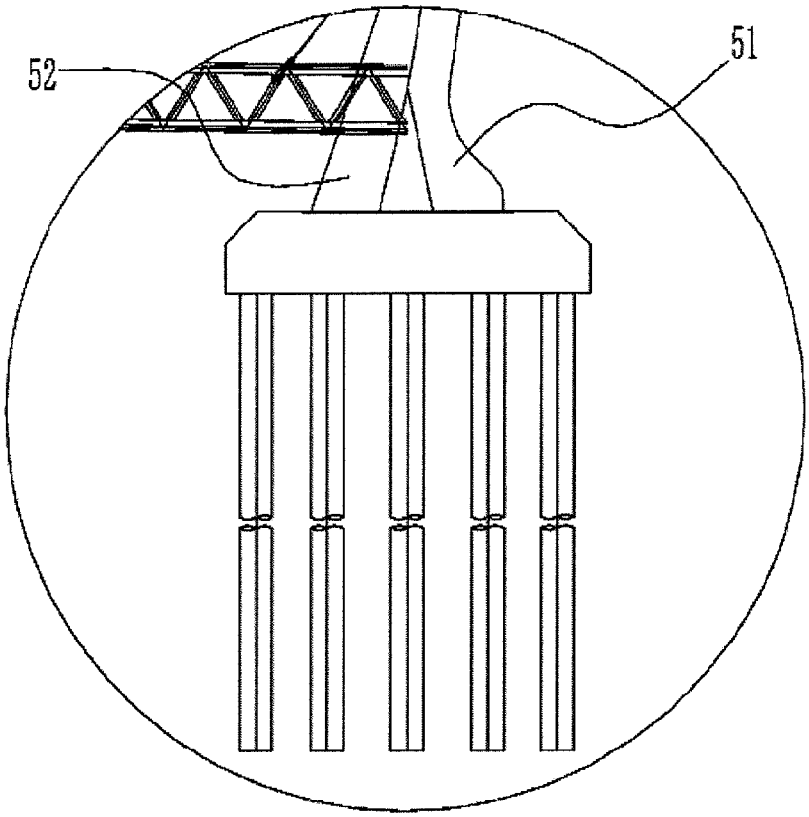
FIG. 3 is an enlarged view of FIG. 1 at A.

Referring to FIG. 2 and FIG. 3, the arch-axis combination 3 includes a lower arch axis 31 and an upper arch axis 32. The lower arch axis 31 is presented as a "V" shape with opening upwards, and fixed to the center abutment 11 at the bottom of the "V" shape. The upper arch axis 32 is presented as a sunken arc and located in the opening of the "V"-shaped lower arch axis 31. The two ends of the upper arch axis 32 are tangentially connected to the two ends of the opening of the "V"-shaped lower arch axis 31 respectively. The arch-axis bending beam 5 butts at the inner end thereof (i.e. the end toward the center abutment) against the corresponding end of the arch-axis combination 3, and forks at the outer end thereof (i.e. the end far away from the center abutment) to form two bending beam legs 51,52. The two bending beam legs 51,52 connect to the auxiliary abutment 13 for enhancing stability. The structure of the arch-axis bending beam 4 is identical to that of the arch-axis bending beam 5, and the way connected to the auxiliary abutment 12 is the same, which will not be repeated herein.

The butt joint between the upper arch axis 32 and each arch-axis bending beam 4,5 is a smooth transition and forms a smooth curve. The arch-axis bending beams 4,5 are connected to the main girder 2 via a plurality of inhaul cables respectively. The arch-axis bending beams 4,5 are formed by a plurality of segments butted in sequence respectively.

Figure 4:
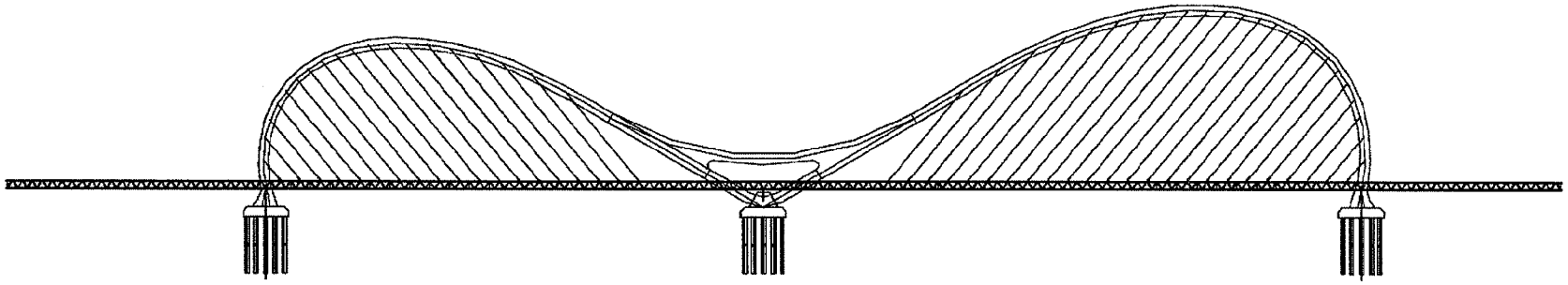
FIG. 4 is a schematic view of a large-span and special-shaped arch bridge according to another embodiment of the present invention.

In addition to the structure that the center abutment located in the middle of the bridge, the structure of the combination arch bridge according to an embodiment of the present invention can also be shown in FIG. 4, that is, the center abutment isn't located in the very center, correspondingly, the spans of the two arch-axis bending beams are different.

Figure 5:
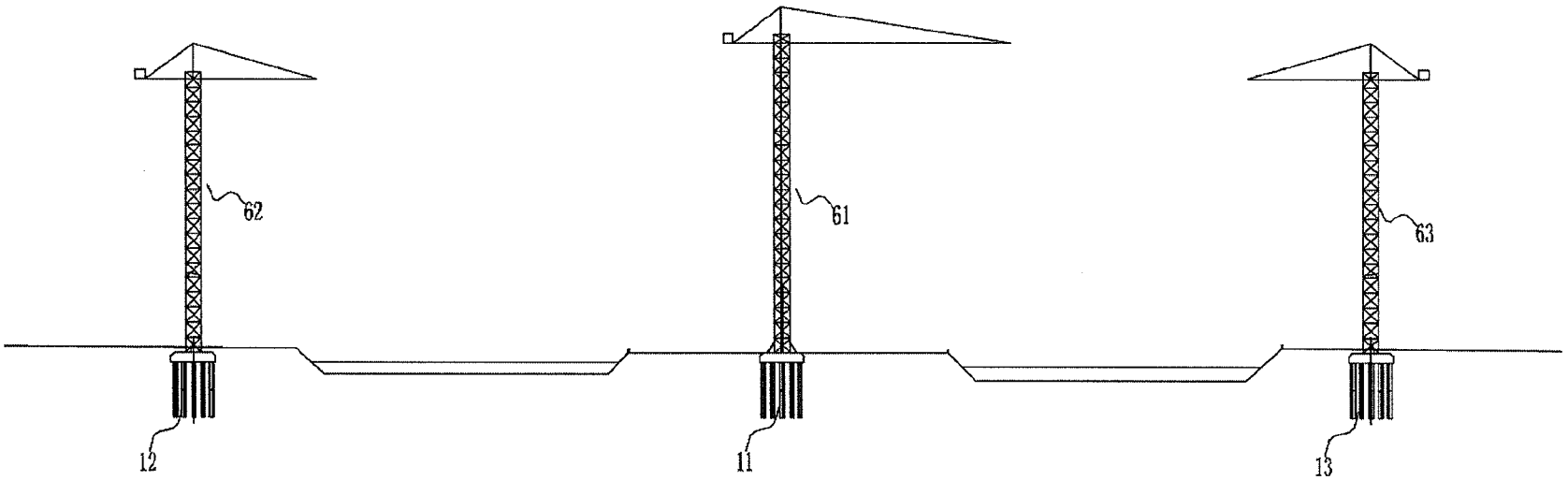
FIG. 5 is a schematic view of the construction method according to an embodiment of the present invention, showing the construction of the abutments and tower cranes.
Figure 6:
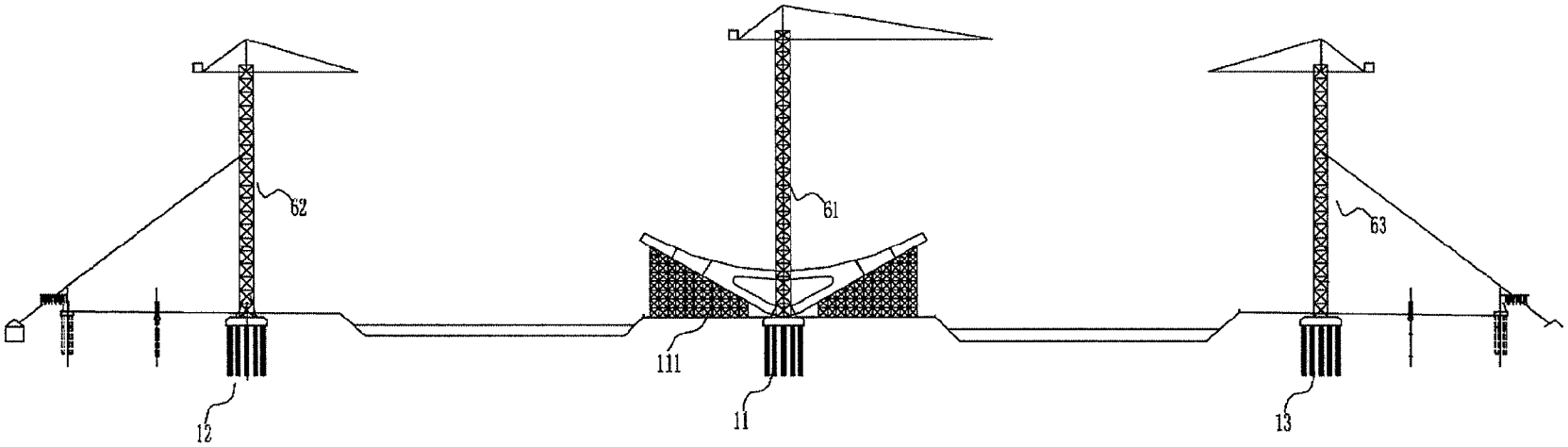
FIG. 6 is a schematic view of the construction method according to an embodiment of the present invention, showing the construction of the arch-axis combination.
Figure 7:
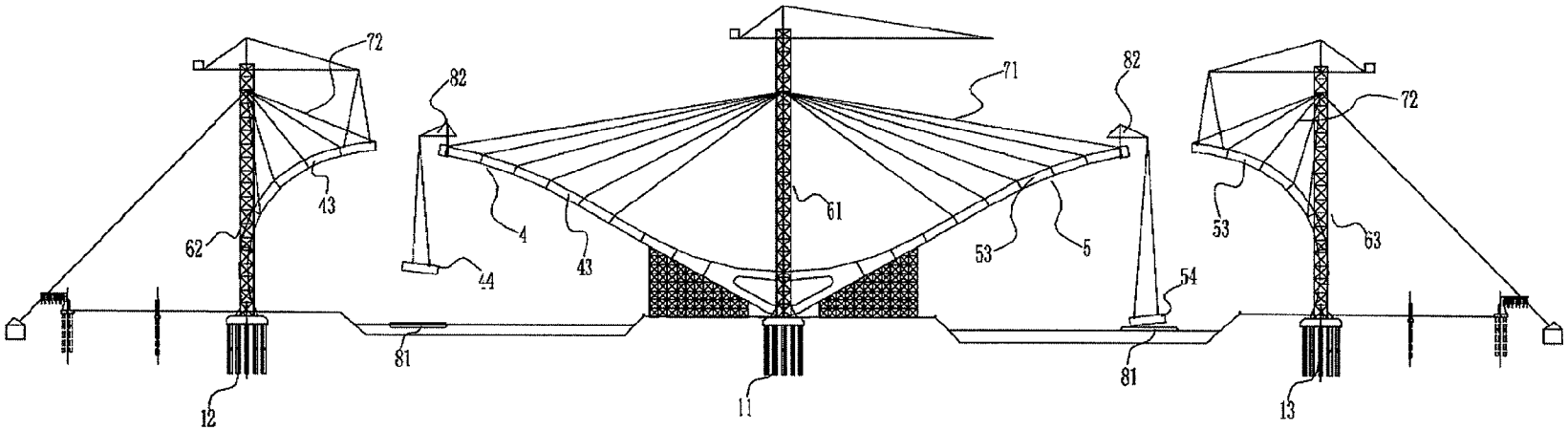
FIG. 7 is a schematic view of the construction method according to an embodiment of the present invention, showing the building of the arch-axis bending beams.

The combination arch bridge can be constructed as follows:

A, referring to FIG. 5, constructing the center abutment 11 and the two auxiliary abutments 12,13, of which the center abutment is stood between the two auxiliary abutments ensuring these three collinear, and building tower cranes 61,62,63 at the center abutment as well as the two auxiliary abutments respectively;

B, referring to FIG. 6, building full scaffoldings 111 accommodated the shape of the arch-axis combination 3 on the center abutment 11, then utilizing the full scaffoldings 111 to build each segment of the arch-axis combination 3 one after another, and every two adjacent segments of the arch-axis combination 3 are connected temporarily by means of inter-tube positioning;

C, building the arch-axis bending beams 4,5 each presented as an arc projected upwards, the step C includes two sub-steps which can be performed simultaneously or can be in any particular order:

In the sub-step C1, referring to FIG. 7, utilizing the tower crane 61 on the center abutment 11 to hoist the segments 43,53 of the arch-axis bending beams 4,5, a plurality of segments 43,53 of the arch-axis bending beams 4,5 are butted in turn from the outer end (i.e. the end far away from the center abutment) of the arch-axis combination 3, where the outer end is served as a starting end, after installing every segment 43,53 of the arch-axis bending beam 4,5, temporarily connecting the segment 43,53 of the arch-axis bending beam 4,5 to the tower crane 61 of the center abutment 11 by means of steel cable 71;

In the sub-step C2, referring to FIG. 7, at the auxiliary abutments 12,13, building the segments 43,53 of the arch-axis bending beams 4,5 by butt joint of the segments in turn from the legs of the outer ends of the arch-axis bending beams 4,5, where the outer ends are away from the center abutment and served as starting ends, each segment 43,53 of the arch-axis bending beam is temporarily connected to the tower crane 62,63 of the auxiliary abutment 12,13, in this respect, every segments 43,53 of the arch-axis bending beam 4,5 is hoisted by the tower crane 62,63 on the auxiliary abutment 12,13.

Figure 8:
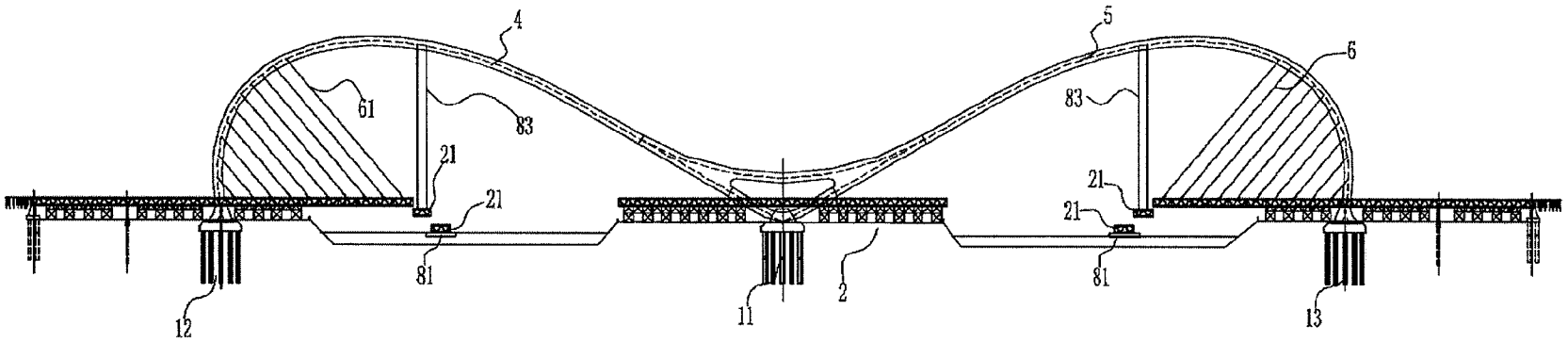
FIG. 8 is a schematic view of the construction method according to an embodiment of the present invention, showing the building of the main girder.

D, referring to FIG. 7 again, by utilizing a transport ship 81, transiting the closure segments 44,54 of the arch-axis bending beams 4,5 to the positions under the nodes of the arch-axis bending beams 4,5 which have been built in the sub-steps C1,C2, and lifting the closure segments 44,54 to an appropriate height via a lifting tool 82 pre-built at the nodes of the arch-axis bending beams 4,5, then docking the closure segments 44,54 with the pre-built nodes at the ends of the arch-axis bending beams 4,5, finally, welding the docking ends of the adjacent segments of the arch-axis bending beams 4,5, thus completing the construction of the arch-axis bending beams 4,5;

E, referring to FIG. 8, building the segment 21 of the main girder 2 toward the center abutment in sequence from the two auxiliary abutments, meanwhile, building the segment 21 of the main girder 2 in sequence from the center abutment 11 to both ends of the bridge, when building the segment 21 of the main girder 2 toward the center abutment in sequence from the two auxiliary abutments, connecting every built segment 21 of the main girder 2 with the arch-axis bending beams 4,5 via inhaul cables 6, in case that the segment 21 of the main girder 2 is far away from the center abutment 11 or from the auxiliary abutment 12,13, transiting the segment 21 by the transport ship 81 to a position just under a predetermined mounting position, and lifting the segment 21 to a predetermined height via the ropes pre-hung at the arch-axis bending beams 4,5 and docking.

F, performing the closure of the main girder, and welding the adjacent segments of the main girder.

For persons skilled in the art, according to the technical solution described above, various changes and modifications may be made, and all such changes and modifications should belong to the scope of the invention as defined by the appended claims.

The invention claimed is:

1. A large-span and special-shaped arch bridge, comprising a main girder, a center abutment configured to serve as a central bearing point and two auxiliary abutments configured to serve as bearing points at two ends, wherein further comprising an arch-axis combination and two arch-axis bending beams presented as arcs projected upwards, the arch-axis combination being built on the center abutment with two ends connected to the inner ends of the two arch-axis bending beams, the outer ends of the two arch-axis bending beams being built on the two auxiliary abutments, the two arch-axis bending beams being connected to the main girder via a plurality of inhaul cables, wherein the arch-axis combination includes a lower arch axis and an upper arch axis, the lower arch axis is presented as a "V" shape and fixed to the center abutment at the bottom of the "V" shape, the upper arch axis is presented as a sunken arc and located in the opening of the "V"-shaped lower arch axis, and the two ends of the upper arch axis are connected to the two ends of the lower arch axis respectively.

2. The large-span and special-shaped arch bridge according to claim 1, wherein the two ends of the upper arch axis are tangent to the two ends of the lower arch axis respectively, and the upper arch axis are butted with the two arch-axis bending beams respectively, which forms smooth curves.

3. The large-span and special-shaped arch bridge according to claim 1, wherein each arch-axis bending beam forks at the outer end thereof to form two bending beam legs connected to each corresponding auxiliary abutment.

4. The large-span and special-shaped arch bridge according to claim 1, wherein each arch-axis bending beam is formed by a plurality of bending beam segments butted in sequence.

5. A construction method of the large-span and special-shaped arch bridge, wherein the large-span and special-shaped arch bridge comprises a main girder, a center abutment configured to serve as a central bearing point and two auxiliary abutments configured to serve as bearing points at two ends, wherein further comprising an arch-axis combination and two arch-axis bending beams presented as arcs projected upwards, the arch-axis combination being built on the center abutment with two ends connected to the inner ends of the two arch-axis bending beams, the outer ends of the two arch-axis bending beams being built on the two auxiliary abutments, the two arch-axis bending beams being connected to the main girder via a plurality of inhaul cables, wherein the arch-axis combination includes a lower arch axis and an upper arch axis, the lower arch axis is presented as a "V" shape and fixed to the center abutment at the bottom of the "V" shape, the upper arch axis is presented as a sunken arc and located in the opening of the "V"-shaped lower arch axis, and the two ends of the upper arch axis are connected to the two ends of the lower arch axis respectively, the method comprising the following steps:

A, constructs abutments including the center abutment located in the middle and two auxiliary abutments located at both ends of the bridge;

B, builds the arch-axis combination on the center abutment with segments one by one, and temporarily connects each segment of the arch-axis combination by means of inter-tube positioning;

C, builds the arch-axis bending beams presented as arcs projected upwards, which includes two sub-steps that can be performed in any particular order:

C1, butts the segments of each arch-axis bending beams in sequence from the built ends of the arch-axis combination to an end away from the center abutment;

C2, butts the segments of the arch-axis bending beams in sequence from each auxiliary abutment to an end near the center abutment;

D, docks the two ends of a closure segments of each arch-axis bending beam respectively with built nodes of each arch-axis bending beam implemented in the sub-steps C1,C2 to perform the closure of each arch-axis bending beam, and welds every adjacent segments of each arch-axis bending beam;

E, builds girder segments in sequence from the two auxiliary abutments to the center abutment, meanwhile builds the girder segments in sequence from the center abutment to both ends of the bridge, when building the girder segments in sequence from the two auxiliary abutments to the center abutment, connects every built girder segment with the corresponding arch-axis bending beam via cables;

F, performs the closure of the main girder, and welds the adjacent girder segments.

6. The construction method according to claim 5, wherein, in the step A, tower cranes are needed to be built respectively on the built center abutment and auxiliary abutments; the step C is specifically as follow:

in the sub-step C1, utilizes the tower crane on the center abutment to hoist the segments of each arch-axis bending beam, a plurality of segments of each arch-axis bending beams are butted in turn from an end of the arch-axis combination away from the center abutment, where the end is served as a starting end, after installing every segment of the arch-axis bending beam, temporarily connects the segments of each arch-axis bending beam to the tower crane of the center abutment by means of steel cable;

in the sub-step C2, builds the segments of each arch-axis bending beam by butt joint of the segments in turn from the legs of an end of each arch-axis bending beam, where the legs are away from the center abutment and served as starting ends, each segment of the arch-axis bending beam is temporarily connected to the tower crane of the corresponding auxiliary abutment, in this respect, every segments of each arch-axis bending beam is hoisted by the tower crane on the corresponding auxiliary abutments.

7. The construction method according to claim 5, wherein in the step D, transits the closure segments of the arch-axis bending beams to the positions under the closure positions of the arch-axis bending beams, and utilizes a lifting tool to hoist the closure segments of the arch-axis bending beams.

* * * * *